United States Patent [19]

Bemmerl

[11] 4,309,130

[45] Jan. 5, 1982

[54] MINE ROOF SUPPORT

[75] Inventor: Hans-Ferdinand Bemmerl, Herne, Fed. Rep. of Germany

[73] Assignee: Bochumer Eisenhütte Heintzmann GmbH & Co., Bochum, Fed. Rep. of Germany

[21] Appl. No.: 156,213

[22] Filed: Jun. 3, 1980

[30] Foreign Application Priority Data

Dec. 7, 1979 [DE] Fed. Rep. of Germany ..... 2928150

[51] Int. Cl.[3] ..... E21D 15/44

[52] U.S. Cl. ..... 405/294; 405/291

[58] Field of Search ..... 405/291-301; 299/31

[56] References Cited

U.S. PATENT DOCUMENTS

| | | | |
|---|---|---|---|
| 3,143,862 | 8/1964 | Cowlishaw | 229/31 X |
| 3,240,022 | 3/1966 | Mills et al. | 405/298 |
| 3,466,875 | 9/1969 | Groetschel | 405/293 |
| 3,812,681 | 5/1974 | Allen | 405/299 |
| 4,231,685 | 11/1980 | Rosenberg et al. . | |

FOREIGN PATENT DOCUMENTS

| | | | |
|---|---|---|---|
| 941767 | 11/1963 | United Kingdom | 405/291 |
| 1521970 | 8/1978 | United Kingdom | 405/291 |

*Primary Examiner*—Dennis L. Taylor
*Attorney, Agent, or Firm*—Michael J. Striker

[57] ABSTRACT

A mine roof support has two sole-sliding elements, a bridge element connecting the sole-sliding elements with one another at the mine face ends of the latter, a roof supporting element supported on the sole-sliding elements, props supporting the roof supporting element on the sole-sliding elements, a displacing arrangement for displacing the sole-sliding elements and connected with the bride element, a guiding arrangement located between the sole-sliding elements and including two laterally spaced guiding rods connected at their mine face ends with a support element and at their backfilling ends with the bridge element via displacing arrangement, wherein a carriage is positively incorporated between the guiding rods of the guiding arrangement. The carriage carries a cylinder-and-piston unit which connects the carriage with the guiding arrangement at the backfilling end of the latter. The carriage also has a coupling member which extends in backfilling direction and connects the carriage with the displacing means at the backfilling end of the latter.

10 Claims, 5 Drawing Figures

1
2
2'
3
4
5
6
7
8
9
10
14
18
19
20
24
43
A
B
C
D
E
F
G
X
II

MINE ROOF SUPPORT

BACKGROUND OF THE INVENTION

The present invention relates to a mine roof support, and more particularly to a shield mine roof support.

It is known to work in a mine face by a peeling or cutting mining device which reciprocates in longitudinal direction of a gallery on longitudinal guides. The removed mineral is conveyed directly from the mining device or from loading arrangement coupled with a mining device, to a continuous conveyor displaceable along the mine face. Then the mineral is delivered to a further conveying arrangement which moves in a mine face gallery at the end side of the first-mentioned gallery.

In connection with this, it is further known to hold open the excavated gallery space, that is so called travel field and conveying field, by shield mine roof supports located adjacent to one another in longitudinal direction of the gallery. Each of the mine roof supports has two sole sliding elements or skis, and a breakage shield-roof supporting arrangement which is supported on the sliding elements by props. The known mine roof support further has a guiding arrangement arranged between the sole sliding elements and including two laterally spaced guiding rods which are connected at their mine face end with a conveyor. The guiding rods are also connected at their backfilling ends with a bridge connecting the mine face ends of the sliding elements, via a displacing arrangement extending toward the mine face. The displacing arrangement in the known mine roof support is formed by a hydraulically actuated cylinder-and-piston unit with a cylinder articulately connected to the bridge and a piston articulately connected to the guiding arrangement. In such a construction the great piston faces of the cylinder-end-piston unit can be utilized for advancing the mine roof support in direction toward the mine face.

The stroke of the displacing arrangement is so selected that the conveyor can be displaced in one or several steps in correspondence with the cutting depths of the respective mining device to follow the mine face, by actuating of the annular face of the cylinder-and-piston unit. When the stroke of the displacement arrangement comes to the end, the mine roof support moves back with abutment against the conveyor.

The cutting depth of a planing mining device amounts only to several centimeter. The cutting depth of the conventionally 2-roller cutting mining arrangement reciprocable relative to the mine face also does not exceed 1 meter. As a result of this, the cylinder-and-piston unit of the displacing arrangement which advances the conveyor or displaces the mine roof support has, in condition of sufficient length, a diameter which corresponds to the mine dimensions. Furthermore, it is known to work in a mine face with the utilization of a generally self-propelling guide-free mining device which is provided at its end face with vertical raisable and lowerable material-removing drum. The latter has as a rule a length of several meters and attains in the mining field a coal-excavating depth which is a multiple of the cutting depth of the reciprocable cutting machine. The mine field to be worked is subdivided by transverse and longitudinal cuts into a plurality of working locations which are worked one after the other or simultaneously whereby several uprights for supporting the mine structure remain spared. In this case one must consciously accept the loss of greater coal quantities which must be retained as supporting uprights because the utilization of working mine roof supports, particularly shield mine roof supports, in condition of mining with such great excavation depths has not been successive. This is because the cylinder-and-piston unit of the displacing means in condition of mine dimensions cannot be formed so long as to cover, as compared with the known planing or cutting methods, a multiple great coal excavating depths with respect to the advancement of the conveyor or the return of the mine roof support.

SUMMARY OF THE INVENTION

Accordingly, it is an object of the present invention to provide a mine roof support which avoids the disadvantages of the prior art.

More particularly, it is an object of the present invention to provide a mine roof support in which a displacing arrangement and a guiding arrangement are so formed that they can be introduced in such mine galleries in which a mine face must be worked in accordance with a method which provides for a considerably greater coal-excavating depth as compared with the planing or cutting longitudinal front mining.

In keeping with these objects and with others which will become apparent hereinafter, one feature of the present invention resides, briefly stated, in a mine roof support in which a carriage is positively incorporated between guiding rods of a guiding arrangement and carries a cylinder-and-piston unit which connects the carriage with the guiding arrangement at the backfilling end of the latter, and the carriage has a coupling member which extends in backfilling direction and connects the carriage with a displacing arrangement at the backfilling end of the latter. An essential feature of the invention is that now the guiding arrangement is incorporated between the sliding elements as a telescopable integral part of the displacing arrangement. The guiding arrangement in accordance with the invention performs now, in addition to its inherent guiding functions, a further function, namely the function of increasing the stroke of the displacing arrangement so that with predetermined mining dimensions both the displacing and the guiding arrangement can perform the advancement or backward displacement within the range between 3 and 3.5 meter which considerably exceeds the range of the known shield mine roof supports. The length-variable incorporation of the carriage in the guiding arrangement, the connection of the backfilling end portions of the displacing arrangement to the carriage, and the connection of the carriage with the backfilling end portion of the guiding arrangement provide for a stroke which is twice as great as the stroke of the cylinder-and-piston unit incorporated between the backfilling end portion of the guiding arrangement and the mine roof support. With such a construction, a conventional mine roof support, with corresponding matching and supporting of the roof-supporting element can be introduced in such mining galleries in which the mine face is worked in by a mining device with the cutting widths equal to 3 meter and more. It is also possible in this case to avoid the utilization of the known support structures and to work in the coal which was retained as the uprights. This also results in considerable increase of the output.

Small loading of the displacing arrangement and its favorable incorporation in the sole-side region of the shield mine roof support is attained in accordance with the present invention in that the displacing arrangement is formed by two laterally adjacent cylinder-and-piston units which are connected at their backfilling ends by a traverse with which the coupling member engages. The coupling member is located in this case between both cylinder-and-piston units substantially in the region of their height.

In connection with this, an advantageous balancing of hydraulic forces which act upon the cylinder-and-piston units of the displacing arrangement and the guiding arrangement is obtained in that the piston chambers and the annular chambers of all cylinder-and-piston units are actuated simultaneously.

In accordance with a further advantageous feature of the present invention, the cylinder of the cylinder-and-piston unit is vertically pivotably connected in its central longitudinal region with the carriage, whereas the free end of the piston rod of the cylinder-and-piston unit is vertically pivotably connected with a traverse connecting the backfilling ends of the guiding rods of the guiding arrangement. Because the cylinder of the cylinder-and-piston unit is fixed in substantially central longitudinal portion, the cylinder-and-piston unit in condition of the expanded displacing arrangement when the conveyor is located directly in front of the end sides of the sole-sliding elements, is so embedded between the sole-sliding elements [or in other words between the guiding rods of the guiding arrangement] that the backfilling ends of both the guiding arrangement and the displacing arrangement are located substantially in the same vertical plane in which the backfilling end of the shield mine roof support is located.

A still further feature of the present invention is that the carriage provided with a longitudinal opening for accommodation of the cylinder of the cylinder-and-piston unit, and the coupling member are of one piece with one another, and are preferably cast. Thereby, a bearing bed for the cylinder-and-piston unit is provided in the carriage without additional welding works, so that the carriage is located deeply between the sole-sliding elements and moreover a quick exchange of the cylinder-and-piston unit for service and repair is guaranteed.

Finally, in accordance with yet another advantageous feature of the present invention, the guiding rods have a U-shaped cross section and are provided with longitudinal passages facing toward one another so that the carriage, or more particularly guiding projections of the carriage, are slidingly received in the passages.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
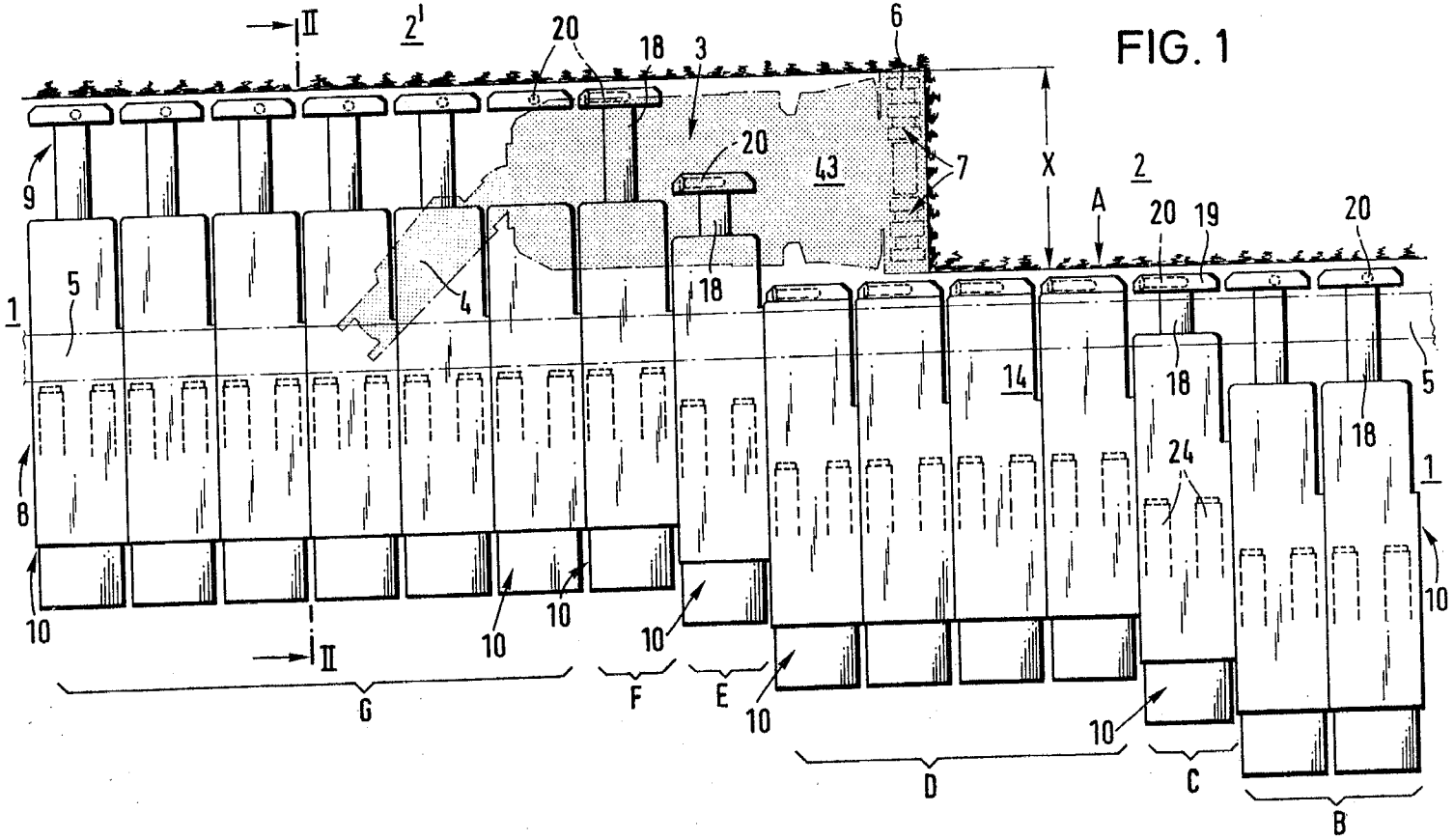
FIG. 1 is a view showing a horizontal longitudinal section of a mine gallery with shield mine roof supports and a schematically shown mining device.

FIG. 1 shows a mine gallery 1 in which a mining device 3 moves in longitudinal direction of the gallery 1 and works in a mine face 2 so as to remove mineral. The mineral is conveyed via an intermediate conveyor 4 to a continuous conveyor 5 movable along the mine face 2, and then the continuous conveyor 5 transports the mineral to a not shown mine conveyor.

The mining device 3 which is self-propelled and not forcedly guided, is provided at its end side with a material-removing drum 7 rotatable about a horizontal axis 6. The material-removing drum 7 is raisable and lowerable in vertical direction. The cutting widths of the material-removing drum 7 and the thereby obtained depths of coal excavation essentially exceeds the cutting depths of a planing tool or a cutting machine reciprocable relative to the mine face. The depths of coal excavation amounts to substantially between 3 and 3.5 meter.

The mine space or the so called travel and conveying field 8, and the mining field 9 worked by the mining device 3, are retained open by shield mine roof supports 10 located laterally adjacent to one another in longitudinal direction of the gallery.

Figure 2:
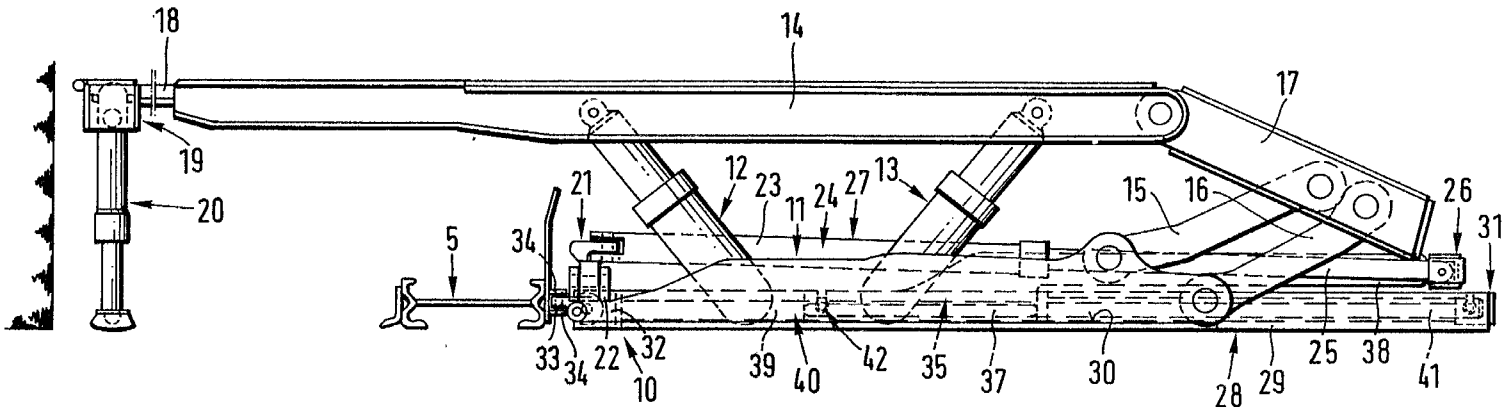
FIG. 2 is a side view of the shield mine roof support taken along the line II—II in FIG. 1.
Figure 4:
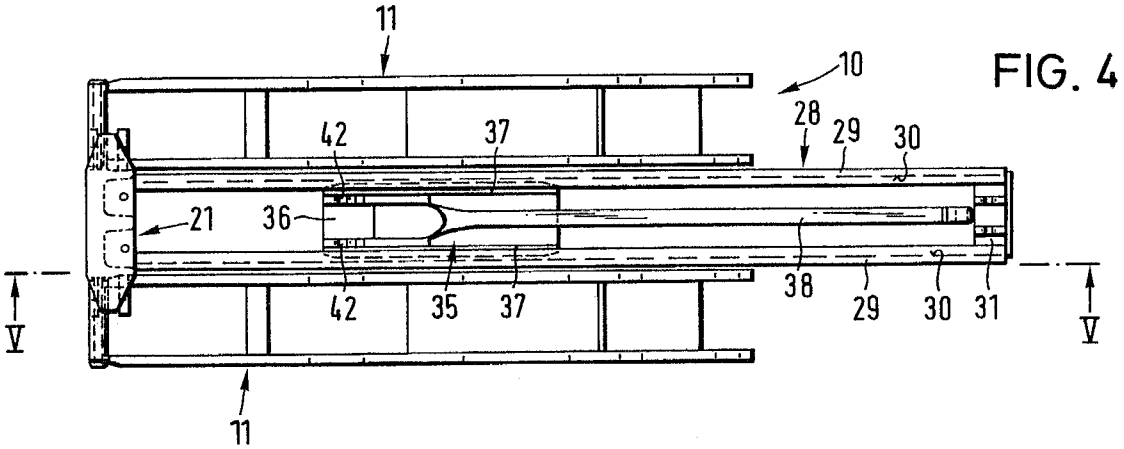
FIG. 4 is a plan view of the shield mine roof support of FIG. 3 in the region of sole sliding elements, wherein a cylinder-and-piston unit is removed.
Figure 5:
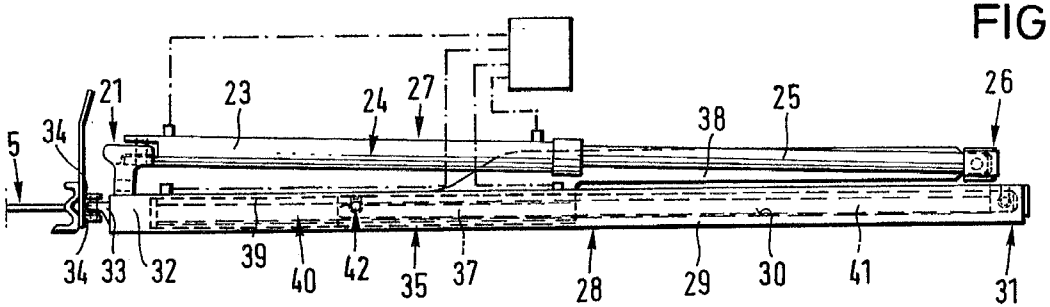
FIG. 5 is a side view in the region of the sole-sliding elements of FIG. 4, taken along the line V—V, wherein the sole-supporting element is removed.

As can be seen from joint consideration of FIGS. 2 and 4, each shield mine roof support 10 has two laterally adjacent sole-sliding elements or skis 11. Two props 12 and 13 are pivotably arranged in the trough-shaped sole-sliding elements 11. The prop 12 located at the mine face side is inclined toward the mine face 2, whereas the prop 13 located at the backfilling side is inclined toward the backfilling end. The props 12 and 13 support a roof-supporting element 14 and are pivotably mounted in the latter.

Two double working members 15 and 16 are connected with the backfilling end portions of the respective sole-sliding elements 11, pivotably in vertical direction. The other end portions of the double working members are pivotably connected with a breakage shield 17. The latter is, in turn, pivotably connected with the backfilling end portion of the roof-supporting element 14. The sole-sliding elements 11, the double working members 15 and 16, and the breakage shield 17 together form a four-bar unit which cooperates with the props 12 and 13 so as to guarantee a rectilinear vertical displacement of the roof-supporting element 14 over a relatively great deposit thickness.

As shown in FIG. 2, the roof-supporting element 14 has an extensible cap 18 which is displaceable in the longitudinal direction. The displacement of the extensible cap 18 is performed by a hydraulically operated cylinder-and-piston unit which is located in the roof-supporting element 14 and not shown in the drawings.

Figure 3:
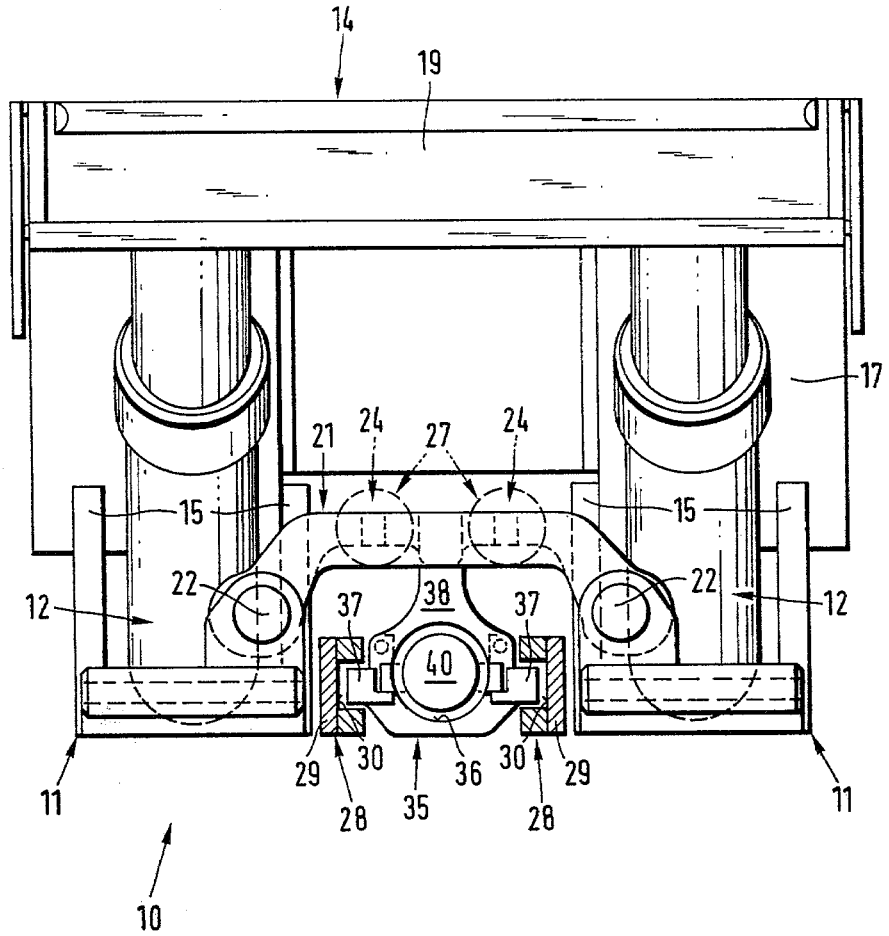
FIG. 3 is an end view of the shield mine roof support in direction of the arrow A in FIG. 1, partially sectioned.

A housing 19 extending in longitudinal direction of the gallery is mounted on the free end portion of the extensible cap 18 [FIG. 3]. A thrust prop is further provided, which can be retracted into the housing 19. The thrust prop 20 is shown in FIG. 2 in the extended position. In contrast, the thrust prop 20 in FIG. 3 is shown as retracted into the housing.

As can further be seen from FIGS. 2–5, the sole-sliding elements 11 are connected at their mine face ends by a bridge 21. Horizontal hinges 22 are provided for this purpose and allow the individual movement of the sole-sliding elements 11. Cylinders 23 of two cylinder-and-piston units 24 arranged adjacent to one another are connected to the bridge 21. The cylinder-and-piston units 24 extend toward the backfilling end and have piston rods 25 whose backfilling ends engage in a housing-shaped traverse 26. These ends are supported in the traverse 26 so as to be spatially pivoted to a limited extent [see particularly FIGS. 2, 3 and 5]. The cylinder-and-piston units 24 form a displacing arrangement 27.

A guiding arrangement 28 is provided between the sole-sliding elements 11. It includes two guiding rods 29 which extend along the inner lateral faces of the sole-sliding elements 11 and have a U-shaped cross section. The U-shaped guiding rods have longitudinal passages 30 which face toward one another. The backfilling end portions of the guiding rods 29 are connected with one another by a traverse 31. The mine face end portions of the guiding rods 29 are connected with one another by a traverse 32. The traverse 32 has a coupling projection 33 for connection with the backfilling side of formations 34 provided on the mine conveyor 5.

The U-shaped guiding rods 29 serve for forced guidance of a carriage 35 which is essentially shorter than the guiding arrangement 28. The carriage 35 has a circular longitudinal recess 36 [FIGS. 3 and 4] and is provided with guiding projections 37 which engage in the longitudinal passages 30 of the guiding rods 29 with required sliding play. The carriage has a cross section decreasing in direction toward the roof and is provided with a small coupling arm 38 extending toward the backfilling end. The coupling arm 38 engages between the cylinder-and-piston unit 24 and has a backfilling end portion supported in a traverse 26. The traverse 26 is housing-shaped and connects the backfilling end portions of the piston rods 25 of the cylinder-and-piston units 24.

The longitudinal recess 36 of the carriage 35 serves for accommodating a cylinder 39 of a hydraulically-operated cylinder-and-piston unit 40. The latter has a piston rod 41 extending toward the backfilling end and having a backfilling end portion which is supported in the traverse 31 connecting the backfilling end of the guiding rods. The support of the cylinder 39 is carried out substantially in its central longitudinal region in a respective recess 42 of the carriage 35 which is here U-shaped and upwardly open.

In the initial position B in FIG. 1, the shield mine roof supports 10 are installed and the extended caps 18 are supported at their free ends by the additional thrust props 20 installed between the conveyor 5 and the mine face 2.

When the mining device 3 approaches, the thrust prop 20 is retracted into the housing 19 at the free end of the cap 18 in accordance with the position C, and the shield mine roof support 10 advances to a predetermined extent in direction toward the mine face 2. This can be advantageously carried out by simultaneous actuation of the piston and annular chambers of the cylinder-and-piston units 24 and 40 of the displacement arrangement 27 and the guiding arrangement 28 as well as of the cylinder-and-piston unit provided in the roof-supporting element 14.

When the mining device 3 further approaches, a further advancement of the shield mine roof supports 10 is performed, until their roof-supporting elements 14 rest directly on the mine face 2. This position is identified in FIG. 1 as the position D. The shield mine roof supports 10 are retained in this position in condition of the displacing mining device 3 so long until the material-removing drum 7 including its pivoting arrangement 43 passes the respective shield mine roof support.

In this situation, the entire mine roof support 10 is advanced in direction towards a new mine face 2' which is offset by the cutting width of the material-removing drum 7. At the same time, the extensible cap 18 with the retracted thrust prop 20 is extended relative to the shield mine roof support 10.

To the moment when the rear end of the mining device 3 passes the shield mine roof support 10, the mine roof support 10 in accordance with the position F is completely drawn to the conveyor 5 and the extensible cap 18 is extended relative to the mine roof support 10 up to the mine face 2'. As soon as the mining device 3 passes the pivoting region of the thrust prop 20, the latter swings down in accordance with the position G to the supporting position shown in FIG. 2, so that now both the travel and conveying field 8 and the excavated mining field 9 are unobjectionably completed by the shield mine roof supports 10.

The mine roof supports 10 maintain this position so long until the mining device 3 reaches the gallery end and moves back into the excavated mining field 9 under the mine roof supports 10 to the starting position. After this, the respective actuation of the cylinder-end-piston units 24 and 40 of the displacement arrangement 27 and the guiding arrangement 28 provides for further displacement of the conveyor 5 to the new mine face 2', until it reaches a position identified as the position B.

It will be understood that each of the elements described above, or two or more together, may also find a useful application in other types of constructions differing from the types described above.

While the invention has been illustrated and described as embodied in a shield mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mine roof support for a mine gallery in which a mining device with a large cutting region works in a mine face and a support element moves along the mine face, the mine roof support comprising two sole sliding elements; a bridge element connecting said sole sliding elements with one another at the mine face ends of the latter; a roof supporting element supported on said sole sliding elements; means for supporting said roof supporting element on said sole sliding elements; means for displacing said sole sliding elements and connected with said bridge element; guiding means arranged between said sole sliding elements and including two laterally spaced guiding rods, said guiding rods being connected at their mine face ends with said support element, said guiding rods being also connected at their backfilling ends with said bridge element via said displacing means; and a carriage positively incorporated between said guiding rods of said guiding means and carrying a cylinder-and-piston unit which connects said carriage with said guiding means at the backfilling end of the latter, said carriage also having a coupling member which extends in backfilling direction and connects said carriage with said displacing means at the backfilling end of the latter.

2. A mine roof support as defined in claim 1, wherein said displacing means includes two further cylinder-and-piston units located laterally adjacent to one another, and a traverse connecting said further cylinder-and-piston units with one another at the backfilling end of the latter, said coupling member engaging said traverse.

3. A mine roof support as defined in claim 1, wherein each of said cylinder-and-piston units has a piston chamber and an annular chamber, the piston chambers and the annular chambers of all said cylinder-and-piston units being actuated simultaneously; and further comprising means for simultaneously actuating the same.

4. A mine roof support as defined in claim 1, wherein said cylinder-and-piston unit has a cylinder having a central portion, said cylinder of said cylinder-and-piston unit being vertically pivotally supported in said carriage, substantially in the region of said central portion.

5. A mine roof support as defined in claim 4, wherein said guiding rods are connected with one another at their backfilling ends by a further traverse, said cylinder-and-piston unit having a piston and a piston rod with a free end portion, said free end portion of said piston rod being vertically pivotally connected with said further traverse.

6. A mine roof support as defined in claim 1, wherein said cylinder-and-piston unit has a cylinder, said carriage having a recess accommodating said cylinder of said cylinder-and-piston unit, said carriage and said coupling member being of one piece with one another.

7. A mine roof support as defined in claim 6, wherein said carriage and said coupling member together form a one-piece cast element.

8. A mine roof support as defined in claim 1, wherein each of said guiding rods has a U-shaped cross section forming a longitudinal passage, said guiding rods being located so that said longitudinal passages of said guiding rods face toward one another, said carriage being slidingly received in said longitudinal passages.

9. A mine roof support as defined in claim 8, wherein said carriage has two lateral projections, each of said projections being slidingly received in the longitudinal passage of a respective one of said guiding bars.

10. A mine roof support as defined in claim 1, wherein said supporting means includes at least one prop.

* * * * *